US010576772B2

(12) United States Patent
Nishio et al.

(10) Patent No.: US 10,576,772 B2
(45) Date of Patent: Mar. 3, 2020

(54) GRAVURE PRINTING ROLL

(71) Applicants: UACJ CORPORATION, Tokyo (JP); UACJ Foil Corporation, Tokyo (JP); THINK LABORATORY CO., LTD., Chiba (JP)

(72) Inventors: Hiroshi Nishio, Tokyo (JP); Yukie Kitada, Tokyo (JP); Tatsuo Shigeta, Chiba (JP)

(73) Assignees: UACJ CORPORATION, Tokyo (JP); UACJ FOIL CORPORATION, Tokyo (JP); THINK LABORATORY CO., LTD., Chiba (JP)

( * ) Notice: Subject to any disclaimer, the term of this patent is extended or adjusted under 35 U.S.C. 154(b) by 0 days.

(21) Appl. No.: 15/548,179

(22) PCT Filed: Feb. 3, 2016

(86) PCT No.: PCT/JP2016/053227
§ 371 (c)(1),
(2) Date: Aug. 2, 2017

(87) PCT Pub. No.: WO2016/125830
PCT Pub. Date: Aug. 11, 2016

(65) Prior Publication Data

US 2018/0015765 A1 Jan. 18, 2018

(30) Foreign Application Priority Data

Feb. 6, 2015 (JP) ..... 2015-022715

(51) Int. Cl.
*B41N 1/20* (2006.01)
*B41N 1/06* (2006.01)
(Continued)

(52) U.S. Cl.
CPC ..... *B41N 1/20* (2013.01); *B41N 1/06* (2013.01); *B41C 1/025* (2013.01); *B41C 1/045* (2013.01);
(Continued)

(58) Field of Classification Search
CPC .. B41N 1/20; B41N 1/06; B41N 3/003; B41C 1/025; B41C 1/045; B41M 1/10; B41M 1/28
See application file for complete search history.

(56) References Cited

U.S. PATENT DOCUMENTS

2007/0007883 A1* 1/2007 Takeda ..... B41M 1/10 313/503
2011/0180826 A1* 7/2011 Morito ..... B41F 3/20 257/89
(Continued)

FOREIGN PATENT DOCUMENTS

JP 10-44635 2/1998
JP 3184707 7/2001
(Continued)

OTHER PUBLICATIONS

International Search Report dated May 10, 2016 in International Application No. PCT/JP2016/053227.

*Primary Examiner* — David H Banh
(74) *Attorney, Agent, or Firm* — Wenderoth, Lind & Ponack, L.L.P.

(57) ABSTRACT

A gravure printing roll that enables printing of fine dots with a size close to that of cells and enables printing on a print subject, such as a printing substrate, without changing the appearance of the print subject. The gravure printing roll includes: a gravure printing roll body; and cells formed in a peripheral surface of the gravure printing roll body. Each of the cells has an opening with a ratio between a dimension in a circumferential direction of the gravure printing roll body
(Continued)

and a dimension in an axial center direction of the gravure printing roll body (dimension in the circumferential direction/dimension in the axial center direction) being 1.15 to 7, and have an opening area of 3900 $\mu m^2$ or smaller.

4 Claims, 5 Drawing Sheets

(51) Int. Cl.

| | |
|---|---|
| *B41C 1/045* | (2006.01) |
| *B41M 1/28* | (2006.01) |
| *B41C 1/02* | (2006.01) |
| *B41M 1/10* | (2006.01) |
| *B41N 3/00* | (2006.01) |

(52) U.S. Cl.
CPC ..... *B41M 1/10* (2013.01); *B41M 1/28* (2013.01); *B41N 3/003* (2013.01)

(56) References Cited

U.S. PATENT DOCUMENTS

| | | | | |
|---|---|---|---|---|
| 2013/0269554 | A1* | 10/2013 | Shigeta ..... | B41N 1/06 101/141 |
| 2015/0352829 | A1 | 12/2015 | Sente et al. | |

FOREIGN PATENT DOCUMENTS

| | | |
|---|---|---|
| JP | 2002-137353 | 5/2002 |
| JP | 2011-11532 | 1/2011 |
| JP | 2013-180404 | 9/2013 |
| JP | 5574209 | 8/2014 |

* cited by examiner

[Fig. 1]
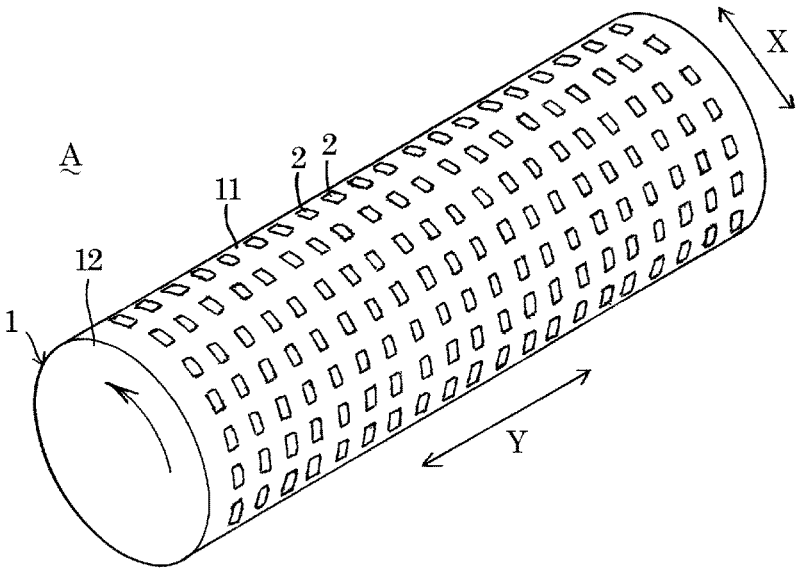
[Fig. 2]
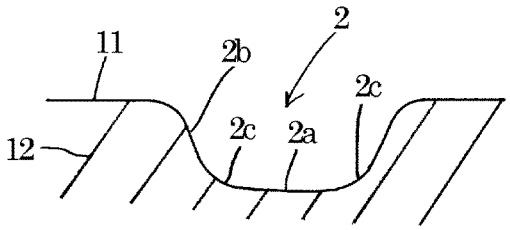

[Fig. 3]
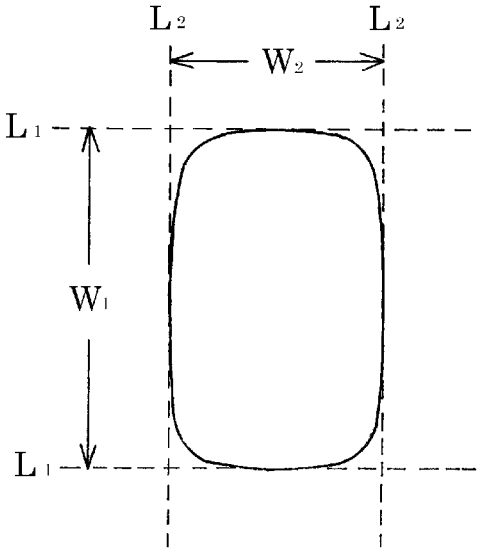

[Fig. 4]
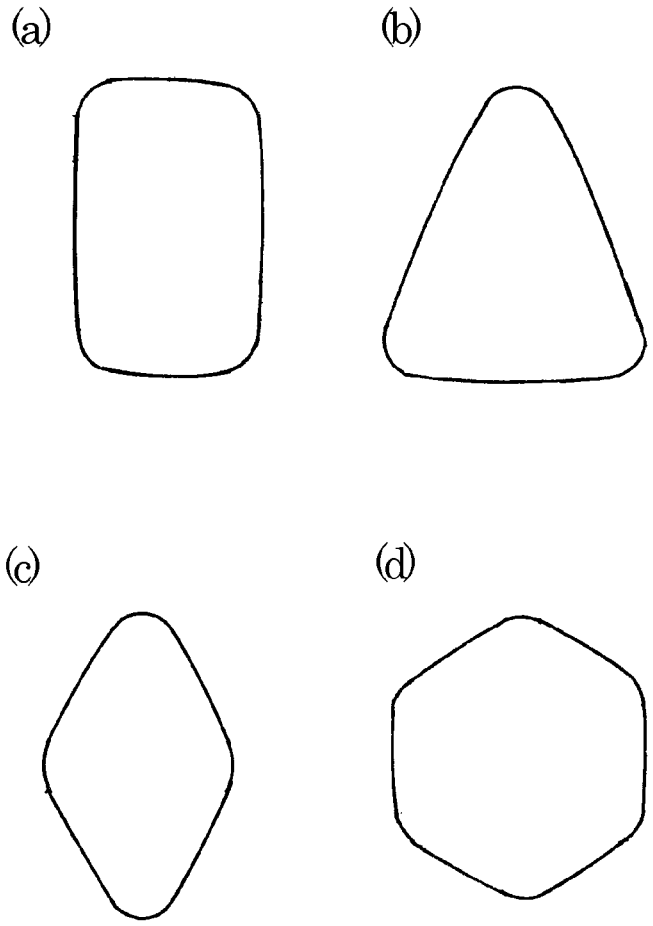

[Fig. 5]
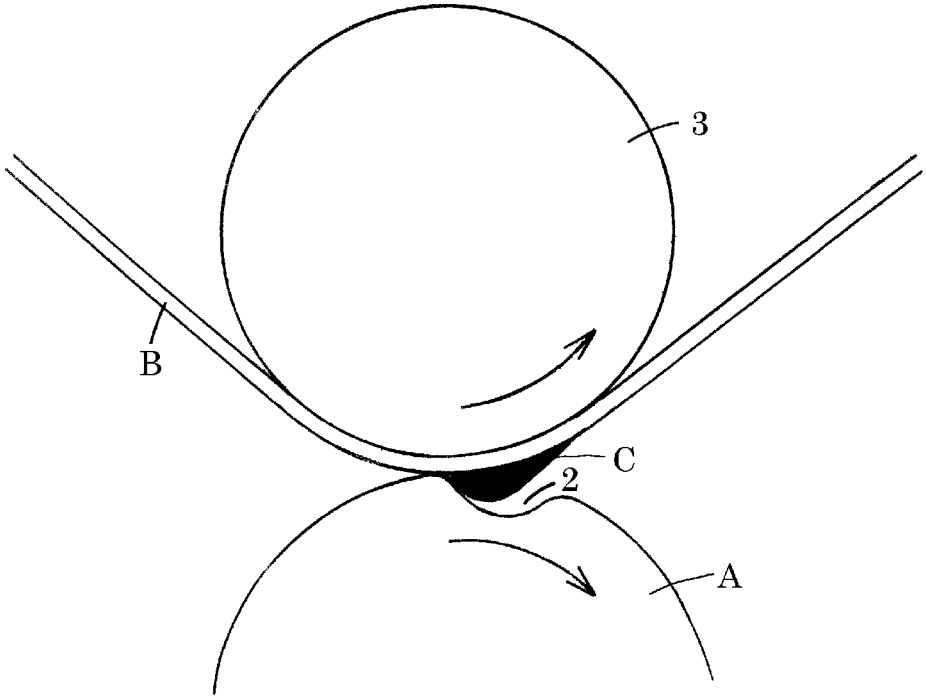
[Fig. 6]
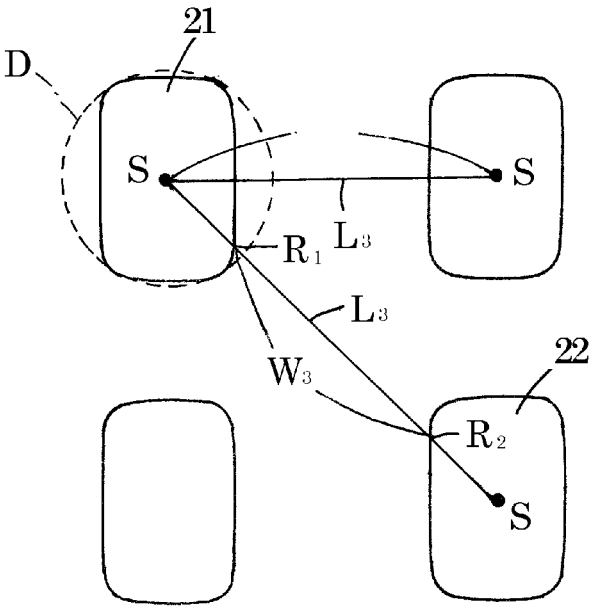

[Fig. 7]
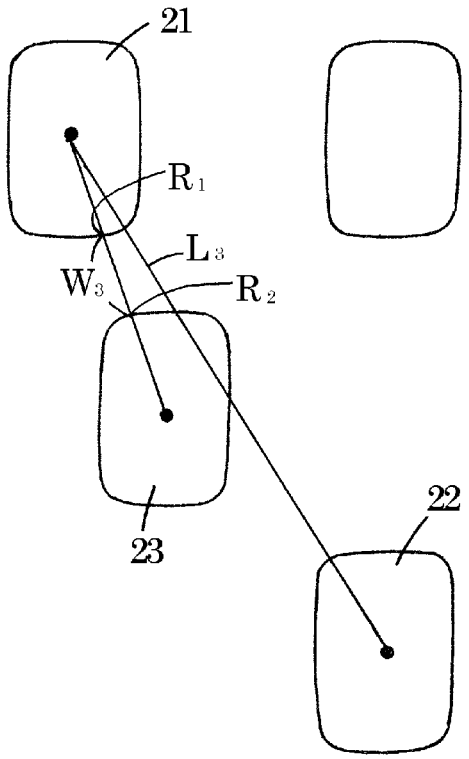
[Fig. 8]
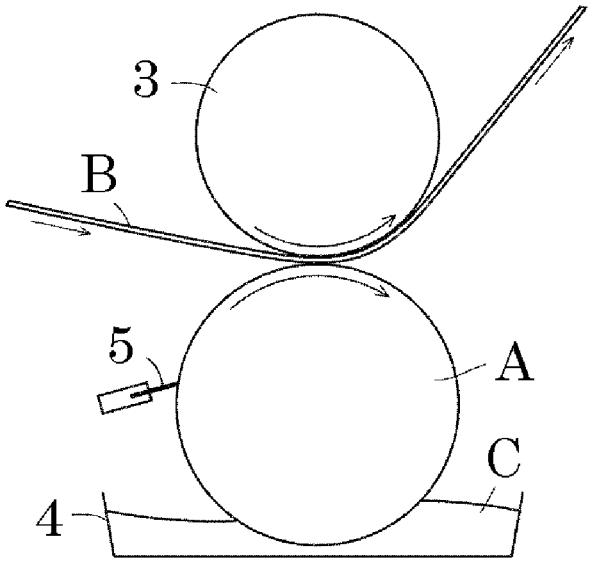

GRAVURE PRINTING ROLL

TECHNICAL FIELD

The present invention relates to a gravure printing roll.

BACKGROUND ART

At present, when prescribing drugs at domestic hospitals or pharmacies, pharmacists prescribe the drugs in accordance with prescriptions issued by doctors. In order to prevent a prescribing error, a plurality of pharmacists check if a kind of drug and its quantity they are about to prescribe to a patient are identical with the kind of drug and its quantity described in the prescription.

However, it is difficult to prevent human errors completely even if checking is performed by a plurality of pharmacists. Thus, measures to prevent prescribing errors have been demanded. In view of this, it is obliged to print a bar code on a rear surface of a PTP packaging body, whereby the use of such a bar code is expected to prevent prescribing errors.

In general, 10 or 12 tablets are stored in a single PTP packaging body. If the number of tablets prescribed to a patient corresponds to a multiple, such as twice or triple, of the number of the tablets stored in the PTP packaging body, a plurality of PTP packaging bodies can be simply prescribed to the patient. In such a case, the bar code labeled on the PTP packaging body can be utilized.

If the number of tablets prescribed to a patient does not correspond to a multiple of the number of the tablets stored in the PTP packaging body, on the other hand, the drug is prescribed to the patient after the PTP packaging body is divided. In general, only one bar code is printed on a PTP packaging body. Therefore, if the PTP packaging body is divided, the divided PTP packaging body often has no bar code. Thus, the bar code cannot be used to prevent prescribing errors.

Thus, in order to solve the above-described problem arising when a PTP packaging body is divided, it is contemplated that a bar code is printed on each of areas corresponding to tablet storing parts in a sealing film of the PTP packaging body.

Gravure printing is typically employed to print a bar code on a PTP packaging body. The gravure printing is a printing method to perform printing on a printing substrate by feeding an ink to cells provided on a surface of a gravure printing roll and transferring the ink to the printing substrate.

Patent Literature 1 proposes a halftone gravure printing plate in which a crossing angle between a right oblique array direction and a left oblique array direction of cells from highlight to shadow is 90 degrees and a crossing angle between the right oblique array direction and a doctor contact line direction has a tilt smaller or larger than 45 degrees by a predetermined angle. In this halftone gravure printing plate, as a result of a laser exposure scan, a cell with a dot percent less than 31% has a shape elongated in a direction perpendicular to the doctor contact line direction, a cell with a dot percent equal to 56% is a rhombus cell, and a cell with a dot percent in a range from 31% to less than 56% has a hollowed rhombus ring shape having an outer peripheral profile same as that of the aforementioned cell with 56%. One of diagonal directions in the aforementioned cells from 31% to 56% is set to be the direction perpendicular to the doctor contact line direction and gradually increasing according to tint gradation levels.

CITATION LIST

Patent Literature

Patent Literature 1: Japanese Patent No. 3184707

SUMMARY OF INVENTION

Technical Problem

Printing a bar code on each of areas corresponding to tablet storing parts in a sealing film of a PTP packaging body, however, significantly changes the appearance of the PTP packaging body. Such a change in the appearance of the PTP packaging body leads to other problems such as making patients worried that the prescribed drug may be wrong and possibly inducing the prescribing errors of the drug by pharmacists. Thus, a printing technique by which printing can be performed on a PTP packaging body without changing the appearance of the PTP packaging body as much as possible has been demanded.

The object of the above-described halftone gravure printing plate is to eliminate moiré in color printing and improve the tint gradation levels. Thus, an ink fed into each of the cells in the halftone gravure printing plate is not fixed on a printing substrate independently from one another after being transferred to the printing substrate, but the ink transferred from each cell is joined and integrated with one another to form a desired picture. Therefore, the above-described halftone gravure printing plate cannot be employed for the printing of fine dots with a size close to that of the cells.

The present invention provides a gravure printing roll that enables printing of fine dots with a size close to that of cells and enables printing on a print subject such as a printing substrate without changing the appearance of the print subject.

Means for Solving Problem

A gravure printing roll of the present invention includes: a gravure printing roll body; and cells formed in a peripheral surface of the gravure printing roll body, wherein the cells each have an opening with a ratio between a dimension in a circumferential direction of the gravure printing roll body and a dimension in an axial center direction of the gravure printing roll body (dimension in the circumferential direction/dimension in the axial center direction) being 1.15 to 7, and have an opening area of 3900 $\mu m^2$ or smaller.

In other words, the gravure printing roll of the present invention is a gravure printing roll including cells formed in a peripheral surface of a gravure printing roll body, and is characterized in that the cell has an opening with a dimension ratio between a circumferential direction and an axial center direction of the gravure printing roll body (circumferential direction/axial center direction) being 1.15 to 7, and has an opening area of 3900 $\mu m^2$ or smaller.

In the above-described gravure printing roll, the opening of the cell has a rectangular shape.

In the above-described gravure printing roll, the cell has a depth of 6 to 25 μm.

Advantageous Effects of Invention

The thus configured gravure printing roll of the present invention enables the ink fed to each of the cells to be smoothly transferred and fixed to a print subject independently from one another. The use of the gravure printing roll of the present invention thus enables the printing of fine dots on a print subject.

BRIEF DESCRIPTION OF DRAWINGS

FIG. 1 is a perspective view illustrating a gravure printing roll.

FIG. 2 is a plan view illustrating a cross section of a cell.

FIG. 3 is a plan view illustrating an opening of a cell.

FIG. 4 is a plan view illustrating openings of cells.

FIG. 5 is a schematic view illustrating the ink in a cell in the middle of being transferred onto a print subject.

FIG. 6 is a diagram illustrating cells adjacent to each other.

FIG. 7 is a diagram illustrating cells adjacent to each other.

FIG. 8 is a schematic view illustrating a gravure printer.

DESCRIPTION OF EMBODIMENTS

An example of a gravure printing roll of the present invention will be described with reference to the drawings. As shown in FIG. 1, a gravure printing roll A is configured to include a large number of cells 2 formed in a peripheral surface of a gravure printing roll body 1.

The cells 2 having openings are formed in a peripheral surface 11 of the gravure printing roll body 1. More specifically, the cells 2 having openings are formed all over a surface part 12 of the gravure printing roll body 1.

As shown in FIG. 2, the cell 2 includes: a bottom surface 2*a* formed in a concave arc shape in cross section; and a peripheral wall part 2*b* gradually extending outward from a peripheral edge of the bottom surface 2*a* toward the peripheral surface (surface) of the gravure printing roll body 1. The bottom surface 2*a* smoothly connects with the peripheral wall part 2*b* by intermediary of a concave arc part 2*c*, so that an ink in the cell 2 can be smoothly withdrawn.

As shown in FIGS. 3 and 4, a ratio between a dimension in a circumferential direction X of the gravure printing roll body 1 and a dimension in an axial center direction Y of the gravure printing roll body 1 (dimension in the circumferential direction/dimension in the axial center direction) (hereinafter referred to simply as a "dimension ratio") in an opening of the cell 2 is 1.15 to 7, preferably 1.2 to 7, and more preferably 1.2 to 6. The dimension ratio of the cell 2 set to be 1.15 or greater can reduce adhesion between the cell 2 and the ink. This can also facilitate the withdrawal of the ink from the cell 2 and thus ensure the withdrawal of the ink from the cell. This also enables sharp dot printing on a print subject without producing an unprinted portion. The dimension ratio of the cell 2 set to be 7 or smaller can prevent the ink from breaking off during the separation of the ink from the cell 2. This also enables the ink to be smoothly withdrawn from the cell 2 and transferred to the print subject. Thus, sharp and accurate dot printing can be achieved on the print subject without producing an unprinted portion.

The circumferential direction X of the gravure printing roll body 1 refers to a rotational direction, i.e., print direction of the gravure printing roll body 1. The axial center direction Y of the gravure printing roll body 1 refers to a direction perpendicular to the rotational direction of the gravure printing roll body 1.

When two straight lines $L_1$, $L_1$ intersecting or in contact with the cell 2 and parallel to the axial center direction of the gravure printing roll body 1 are drawn, the dimension of the cell in the circumferential direction of the gravure printing roll body 1 refers to a maximum distance $W_1$ between the two straight lines $L_1$, $L_1$.

When two straight lines $L_2$, $L_2$ intersecting or in contact with the cell 2 and parallel to the circumferential direction of the gravure printing roll body 1 are drawn, the dimension of the cell in the axial center direction of the gravure printing roll body 1 refers to a maximum distance $W_2$ between the two straight lines $L_2$, $L_2$.

The shape of the opening of the cell 2 is not limited to a particular shape so long as the above-described dimension ratio and an opening area to be described later fall within respective predetermined ranges. Examples of the shape of the opening include polygons, such as a triangle (for example, FIG. 4(*b*)), a quadrangle, a pentagon, and a hexagon (for example, FIG. 4(*d*)). Preferred shapes are a triangle and a quadrangle, and a more preferred shape is a rectangle. Examples of the quadrangle include a rectangle (for example, FIG. 4(*a*)) and a parallelogram (such as a rhombus (for example, FIG. 4(*c*))). Note that corners of such a polygon may be formed in an arc shape. Each side of the polygon does not need to be straight, but may be curved.

Although the mechanism that enables the ink in the cell 2 to be smoothly transferred and fixed to the print subject by setting the dimension ratio of the cell within the above-described range has not been made clear, the following is thought to be the reason.

As shown in FIG. 5, an ink C is first fed into the cells 2 of the gravure printing roll A in order to perform printing on a print subject B with the gravure printing roll A. Thereafter, the print subject B is fed between the gravure printing roll A and a back-up roll 3, and the ink C in the cells 2 of the gravure printing roll A is transferred and fixed onto the print subject B.

More specifically, the print subject B is first in contact with the openings of the cells 2. As shown in FIG. 5, the print subject B is gradually separated from the openings of the cells 2 along with the rotation of the gravure printing roll A. The print subject B is sequentially stripped off starting with the leading side of the gravure printing roll A in the rotational direction. The ink C withdrawn from the cells 2 is sequentially transferred to the stripped portion. In order for the ink C to be withdrawn from the cell 2 and transferred to the print subject B, adhesion between the print subject B and the ink C needs to be greater than adhesion between the cell 2 and the ink C. In view of this, the dimension ratio in the opening of the cell 2 in the above-described gravure printing roll A is set to 1.15 to 7, so that the opening of the cell 2 has a shape elongated in the circumferential direction of the gravure printing roll body 1. When cells having the same opening area are compared with each other, one with a shape elongated in the circumferential direction X of the gravure printing roll body 1 can reduce adhesion between the cell 2 and the ink C due to its reduced ink amount in the axial center direction Y. Consequently, the adhesion between the print subject B and the ink C can be made greater than the adhesion between the cell 2 and the ink C. This is assumed to be the reason why the ink C can be easily withdrawn from the cell 2 and easily transferred and fixed onto the print subject B.

The opening area of the cell 2 in the gravure printing roll A is 3900 $\mu m^2$ or smaller, preferably 3600 $\mu m^2$ or smaller, more preferably 2500 $\mu m^2$ or smaller, and particularly preferably 2000 $\mu m^2$ or smaller. The opening area of the cell 2 set to be 3900 $\mu m^2$ or smaller enables the printing of fine dots with a diameter of 100 μm or smaller, in particular, fine dots with a diameter of about 20 to 50 μm, which can be hardly identified by human eyes.

The opening area of the cell 2 in the gravure printing roll A is preferably 200 $\mu m^2$ or greater, more preferably 300 $\mu m^2$ or greater, and particularly preferably 400 $\mu m^2$ or greater. The opening area of the cell 2 set to be 200 $\mu m^2$ or greater enables smoother withdrawal of the ink from the cell 2 and sharp dot printing on the print subject.

The depth of the cell 2 in the gravure printing roll A is preferably 6 to 25 μm, and more preferably 10 to 25 μm. The depth of the cell 2 set within the aforementioned range enables smoother withdrawal of the ink from the cell 2 and sharp dot printing on the print subject. Note that the depth of the cell 2 refers to the depth of the deepest portion.

The interval between the cells 2 adjacent to each other in the gravure printing roll A may be any distance as long as the ink parts withdrawn from the respective cells 2 and transferred to the print subject are prevented from being merged and integrated with each other on the print subject. Specifically, the interval between the cells 2 adjacent to each other in the gravure printing roll A is preferably 50 to 1000 μm, more preferably 100 to 800 μm, and particularly preferably 150 to 500 μm.

Note that cells adjacent to each other and an interval therebetween are defined in the following manner. As shown in FIG. 6, a perfect circle D with the minimum diameter capable of surrounding the opening of the cell is drawn, and then the center of the perfect circle D is defined as a cell center S.

A straight line $L_3$ connecting between the cell centers S, S of cells 21 and 22 is drawn. As shown in FIG. 6, if there is no other cell on the straight line $L_3$, the cell 21 and the cell 22 have an adjacent relationship to each other. As shown in FIG. 7, on the other hand, if another cell 23 is present on the straight line $L_3$, the cell 21 and the cell 22 have no adjacent relationship to each other.

The interval between the cells adjacent to each other refers to a distance $W_3$ between points $R_1$ and $R_2$ at which the straight line $L_3$ intersects with the opening edges of the cells 21 and 22.

The formation density of the cells 2 in the gravure printing roll A is preferably 25 cells/$mm^2$ or smaller, more preferably 10 cells/$mm^2$ or smaller. The formation density of the cells 2 set within the aforementioned range enables the ink parts withdrawn from the respective cells in the gravure printing roll A and transferred onto the print subject to be transferred and fixed onto the print subject independently without being merged with one another. Thus, sharp dots can be printed on the print subject.

A method for manufacturing the gravure printing roll A will be described next. The gravure printing roll A can be manufactured by known manufacturing methods.

The gravure printing roll body 1 described above is typically made of a metal such as iron or aluminum. The surface of the gravure printing roll body 1 includes a plating layer (surface layer) made of copper, for example. The cells 2 are then formed on the surface of the plating layer in the gravure printing roll body 1 by a chemical method or a mechanical method. In this manner, the gravure printing roll A can be manufactured. Note that the surface of the plating layer is subjected to chrome plating, for example, after the formation of the cells 2 in the plating layer of the gravure printing roll body 1.

As a method for forming cells by a chemical method, the surface of the plating layer of the gravure printing roll body 1 is subjected to mirror polishing, and then a photosensitizer is applied to the surface of the plating layer (surface layer). After the photosensitizer is cured so as to form a negative type of a cell pattern (dot pattern), uncured part of the photosensitizer is removed. The portion of the plating layer uncovered by the photosensitizer is subjected to etching by an etching solution so as to form recesses. In this manner, the cells can be formed.

Alternatively, as a method for forming cells by a mechanical method, for example, the plating layer (surface layer) of the gravure printing roll body 1 is subjected to mirror polishing. Thereafter, the surface of the plating layer is subjected to engraving with a diamond needle called a stylus so as to form recesses. In this manner, the cells can be formed.

A procedure to perform dot printing on a print subject with the above-described gravure printing roll A will be described next. First, a gravure printer employed in a gravure printing method will be described. In FIG. 8, the letter A denotes the gravure printing roll, and an application liquid pan 4 for storing the ink C is disposed below the gravure printing roll A. Note that a doctor blade 5 for removing excess ink adhering to the outer peripheral surface of the gravure printing roll A is disposed on the lateral side of the gravure printing roll A.

Furthermore, the back-up roll 3 is disposed above the gravure printing roll A. The gravure printing roll A and the back-up roll 3 are configured to sandwich and press the print subject B by their surfaces facing each other.

The print subject B is not limited to a particular print subject. Examples of the print subject B include a laminated sheet including a metal foil (for example, an aluminum foil or the like) and a synthetic resin film integrally laminated on the metal foil, and a laminated sheet including a metal foil (for example, an aluminum foil or the like) and a print layer formed on a surface of the metal foil.

Furthermore, the ink C is fed into the application liquid pan 4. A lower part of the gravure printing roll A is immersed in the ink C in the application liquid pan 4. Along with the clockwise rotation of the gravure printing roll A in FIG. 8, the ink C excessively fed to the cells 2 of the gravure printing roll A is removed by the doctor blade 5.

Thereafter, the elongated print subject B is continuously fed between the facing surfaces of the gravure printing roll A and the back-up roll 3. By pressing the print subject B from the both sides thereof by the gravure printing roll A and the back-up roll 3, the ink C held in each of the cells 2 is transferred onto the print subject B. The ink C is then dried. In this manner, dot printing can be performed on the print subject B.

The ink transferred onto the print subject B is fixed independently from one another without being merged and integrated with one another on the print subject B. Thus, dots each having an area close to the opening area of the cell in the gravure printing roll A are printed on the print subject B.

The ink fed into the cells 2 of the gravure printing roll A is reliably transferred onto the print subject B. Thus, a dot pattern with no unprinted portions is beautifully printed on the print subject B.

Since the dots printed on the print subject each have a very small diameter of 100 μm or smaller, such dots can be hardly identified by human eyes. Note that the diameter of a dot refers to the diameter of a perfect circle with the minimum diameter capable of surrounding the dot.

Therefore, the above-described gravure printing roll A enables dot printing on a print subject without changing the appearance thereof. For example, the gravure printing roll A can be used to print dots on a surface of a drug packaging body (for example, a PTP (press through pack) packaging body, a pouched packaging body, an SP (strip package) packaging body) without changing the appearance thereof. In the case of the PTP packaging body, for example, dots can be printed on the entire outer surface of a sealing film without changing the appearance of the sealing film. A drug code is configured by a plurality of dots, and arrangement patterns of dots are varied to correspond to respective drugs. With a dot arrangement pattern corresponding to a drug stored in a drug packaging body, a plurality of dots are printed on the outer surface of the drug packaging body with the gravure printing roll A. In this manner, a drug code corresponding to a drug stored in a drug packaging body can be printed on the outer surface of the packaging body without changing the appearance of the packaging body. By reading the drug code with a known reader, the drug stored in the packaging body can be checked.

EXAMPLES

While the present invention will be described more specifically by way of examples, the present invention is not limited thereto.

Examples 1 to 11, Comparative Examples 1 and 2

Gravure printing rolls A each including a huge number of cells 2, each of which had an opening of a rectangular or square shape, formed in a peripheral surface 11 (surface part 12) of a gravure printing roll body 1 were prepared. The corners of the opening of the cell were all formed in an arc shape. The cell 2 included: a bottom surface 2*a* formed in a concave arc shape in cross section; and a peripheral wall part 2*b* gradually extending outward from a peripheral edge of the bottom surface 2*a* toward the peripheral surface of the gravure printing roll body 1. The bottom surface 2*a* smoothly connected with the peripheral wall part 2*b* by intermediary of a concave arc part 2*c*. The bottom surface 2*a* had a plane rectangle or square shape. When the opening of the cell 2 and the bottom surface 2*a* each had a rectangular shape, the long side of the rectangle was positioned along the circumferential direction X of the gravure printing roll body 1. When the opening of the cell 2 and the bottom surface 2*a* each had a square shape, two sides opposed to each other among the sides of the square were positioned along the circumferential direction X of the gravure printing roll body 1. Dimensions of the openings of the cells in the circumferential direction X and in the axial center direction Y of the gravure printing roll bodies as well as depths thereof were as shown in Table 1. Opening areas of the cells were as shown in Table 1. Intervals between adjacent cells were as shown in Table 1. Formation densities of the cells were as shown in Table 1.

Gravure printing was performed with the gravure printer shown in FIG. 8. A laminated sheet in which a white ink (manufactured by Fuji Ink Corporation, under the trade name of "MBA White") was applied all over a surface of an aluminum foil with a thickness of 17 μm was used as a print subject B.

Ink (manufactured by Fuji Ink Corporation, under the trade name of "MBA Black Ink") C was fed into the application liquid pan 4. Along with the clockwise rotation of the gravure printing roll A in FIG. 8, the ink C excessively fed to the cells 2 of the gravure printing roll A was removed by the doctor blade 5.

Thereafter, the elongated laminated sheet B was continuously fed between the facing surfaces of the gravure printing roll A and the back-up roll 3. By pressing the laminated sheet B from the both sides thereof by the gravure printing roll A and the back-up roll 3, the ink C held in the cells 2 was transferred onto the laminated sheet B. The ink C was then dried. In this manner, dot printing was performed on the laminated sheet B. The laminated sheet B was fed between the facing surfaces of the gravure printing roll A and the back-up roll 3 so that the surface of the laminated sheet B applied with the white ink was positioned closer to the gravure printing roll A.

Example 12

A gravure printing roll A including a huge number of cells, each of which had an opening of an isosceles triangular shape elongated in the circumferential direction of a gravure printing roll body, formed in a peripheral surface 11 (surface part 12) of the gravure printing roll body 1 was prepared. The cell 2 included: a bottom surface 2*a* formed in a concave arc shape in cross section; and a peripheral wall part 2*b* gradually extending outward from a peripheral edge of the bottom surface 2*a* toward the peripheral surface of the gravure printing roll body 1. The bottom surface 2*a* smoothly connected with the peripheral wall part 2*b* by intermediary of a concave arc part 2*c*. The bottom surface 2*a* had an isosceles triangular shape. The base of the isosceles triangle was positioned along the axial center direction Y of the gravure printing roll body 1. The dimensions of the opening of the cell in the circumferential direction and the axial center direction of the gravure printing roll body as well as the depth thereof were as shown in Table 1. The opening area of the cell was as shown in Table 1. The interval between adjacent cells was as shown in Table 1. The formation density of the cells was as shown in Table 1.

Dot printing was performed on a print subject in the same manner as that in Example 1 except that the above-described gravure printing roll A was employed. The cells were configured such that the vertex of the isosceles triangle, which was the shape of the opening of the cell, was positioned on the leading side in the rotational direction of the gravure printing roll A.

In each of Examples, the ink transferred onto the laminated sheet B was fixed independently from one another without being merged and integrated with one another on the laminated sheet B. Dots corresponding to the cells were formed independently from one another on the laminated sheet B.

Fixing rates and dot shapes of the resultant dot print on the laminated sheets were measured in the following manner and their results were shown in Table 1.

(Fixing Rate)

A photomicrograph of the dot print on the laminated sheet was taken at a 200-fold magnification. Ten measuring zones each in the shape of a square with a side of 2 mm were determined in arbitrary portions on the photomicrograph. The number of dots present in each measuring zone was counted. In each measuring zone, the fixing rate was calculated in accordance with the following formula. The arithmetic mean value of the fixing rates in the measuring zones was calculated. Such an arithmetic mean value was employed as a fixing rate. Note that dots partially present in the measuring zones were excluded. In Comparative Example 2, the ink broke off during the separation of the ink from the cell. Thus, accurate dot printing was unable to be performed. Since the number of printed dots was greater than the number of the cells in the gravure printing roll, the fixing rate was over 100%.

Fixing rate (%)=100×(the number of dots within a measuring zone)/(the number of cells formed in a gravure printing roll per 4 $mm^2$)

(Dot Shape)

A photomicrograph of the dot print on the laminated sheet was taken at a 200-fold magnification. A measuring zone in the shape of a square with a side of 1 cm was determined in an arbitrary portion on the photomicrograph. Dimensions of each dot in the measuring zone in the circumferential direction and the axial center direction of the gravure printing roll body were measured. The arithmetic mean value of the dimensions of the dots in the circumferential direction and the arithmetic mean value of the dimensions of the dots in the axial center direction were calculated. Such arithmetic mean values were shown in Table 1. Note that dots partially present in the measuring zone were excluded.

CROSS REFERENCE TO RELATED APPLICATIONS

This application claims the benefit of Japanese Patent Application No. 2015-22715, filed on Feb. 6, 2015, the disclosure of which is hereby incorporated in its entirety by reference.

INDUSTRIAL APPLICABILITY

The gravure printing roll of the present invention can print dots hardly identifiable by human eyes without producing unprinted portions. Thus, a dot pattern can be sharply printed on a print subject without changing the appearance thereof. Therefore, the gravure printing roll of the present invention can be preferably used to print a dot pattern on a surface of a print subject, such as a drug packaging body, for which a change in its appearance is unfavorable.

TABLE 1

| | CELL | | | | | |
|---|---|---|---|---|---|---|
| | OPENING SHAPE | BOTTOM SURFACE SHAPE | DIMENSION IN CIRCUMFERENTIAL DIRECTION (μm) | DIMENSION IN AXIAL CENTER DIRECTION (μm) | DIMENSION RATIO | DEPTH (μm) |
| EXAMPLE 1 | RECTANGLE | RECTANGLE | 73 | 53 | 1.38 | 10 |
| EXAMPLE 2 | RECTANGLE | RECTANGLE | 54 | 33 | 1.64 | 10 |
| EXAMPLE 3 | RECTANGLE | RECTANGLE | 66 | 18 | 3.67 | 10 |
| EXAMPLE 4 | RECTANGLE | RECTANGLE | 64 | 41 | 1.56 | 10 |
| EXAMPLE 5 | RECTANGLE | RECTANGLE | 56 | 17 | 3.29 | 10 |
| EXAMPLE 6 | RECTANGLE | RECTANGLE | 83 | 27 | 3.07 | 10 |
| EXAMPLE 7 | RECTANGLE | RECTANGLE | 79 | 15 | 5.27 | 10 |
| EXAMPLE 8 | RECTANGLE | RECTANGLE | 67 | 19 | 3.53 | 10 |
| EXAMPLE 9 | RECTANGLE | RECTANGLE | 56 | 14 | 4.00 | 10 |
| EXAMPLE 10 | RECTANGLE | RECTANGLE | 47 | 20 | 2.35 | 10 |
| EXAMPLE 11 | RECTANGLE | RECTANGLE | 45 | 15 | 3.00 | 10 |
| EXAMPLE 12 | ISOSCELES TRIANGLE | ISOSCELES TRIANGLE | 44 | 38 | 1.16 | 10 |
| COMPARATIVE EXAMPLE 1 | RECTANGLE | RECTANGLE | 41 | 42 | 0.98 | 14 |
| COMPARATIVE EXAMPLE 2 | RECTANGLE | RECTANGLE | 106 | 15 | 7.07 | 10 |

| | CELL | | | DOT | | |
|---|---|---|---|---|---|---|
| | OPENING AREA ($\mu m^2$) | INTERVAL (μm) | FORMATION DENSITY (THE NUMBER OF CELLS/$mm^2$) | FIXING RATE (%) | CIRCUM-FERENTIAL DIRECTION (μm) | AXIAL CENTER DIRECTION (μm) |
| EXAMPLE 1 | 3869 | 200-500 | 10 | 100 | 80 | 52 |
| EXAMPLE 2 | 1782 | 200-500 | 10 | 95.6 | 43 | 32 |
| EXAMPLE 3 | 1188 | 200-500 | 10 | 79.6 | 64 | 44 |
| EXAMPLE 4 | 2624 | 200-500 | 10 | 75.0 | 61 | 42 |
| EXAMPLE 5 | 952 | 200-500 | 10 | 71.6 | 61 | 46 |
| EXAMPLE 6 | 2241 | 200-500 | 10 | 100 | 86 | 59 |
| EXAMPLE 7 | 1185 | 200-500 | 10 | 98.7 | 76 | 40 |
| EXAMPLE 8 | 1273 | 200-500 | 10 | 93.3 | 64 | 44 |
| EXAMPLE 9 | 784 | 200-500 | 10 | 100 | 44 | 38 |
| EXAMPLE 10 | 940 | 200-500 | 10 | 96.0 | 56 | 45 |
| EXAMPLE 11 | 675 | 200-500 | 10 | 89.3 | 40 | 40 |
| EXAMPLE 12 | 836 | 200-500 | 10 | 65.0 | 58 | 50 |
| COMPARATIVE EXAMPLE 1 | 1722 | 200-500 | 10 | 50.0 | 61 | 61 |
| COMPARATIVE EXAMPLE 2 | 1590 | 200-500 | 10 | 180 | 70 | 40 |

REFERENCE SIGNS LIST

1 gravure printing roll body
11 peripheral surface
12 surface part
2 cell
2*a* bottom surface
2*b* peripheral wall part
A gravure printing roll
B print subject, laminated sheet
C ink
X circumferential direction
Y axial center direction

The invention claimed is:

1. A gravure printing roll comprising:

a gravure printing roll body; and cells formed in a peripheral surface of the gravure printing roll body, the cells each having an opening with a ratio between a dimension in a circumferential direction of the gravure printing roll body and a dimension in an axial center direction of the gravure printing roll body, dimension in the circumferential direction/dimension in the axial center direction, being 1.16 to 5.27, the cells each having an opening area of 675 to 3869 $\mu m^2$ and a formation density of the cells in the gravure printing roll being 25 cells/$mm^2$ or smaller.

2. The gravure printing roll according to claim 1, wherein the opening of each of the cells has a rectangular shape.

3. The gravure printing roll according to claim 1, wherein the cells each have a depth of 6 to 25 μm.

4. The gravure printing roll according to claim 2, wherein the cells each have a depth of 6 to 25 μm.

* * * * *